US008575077B2

(12) United States Patent
Smith et al.

(10) Patent No.: US 8,575,077 B2
(45) Date of Patent: Nov. 5, 2013

(54) ENVIRONMENTAL SUBSEA CONTROL HYDRAULIC FLUID COMPOSITIONS

(76) Inventors: Ian D. Smith, Adlington (GB); John C. Kennedy, Stockport (GB)

( * ) Notice: Subject to any disclaimer, the term of this patent is extended or adjusted under 35 U.S.C. 154(b) by 868 days.

(21) Appl. No.: 12/549,579

(22) Filed: Aug. 28, 2009

(65) Prior Publication Data

US 2010/0016187 A1 Jan. 21, 2010

Related U.S. Application Data

(63) Continuation-in-part of application No. 12/173,284, filed on Jul. 15, 2008.

(51) Int. Cl.
*C10M 173/02* (2006.01)
*C10M 169/04* (2006.01)

(52) U.S. Cl.
USPC ..... 508/110; 508/170; 508/469

(58) Field of Classification Search
USPC ..... 508/154, 156, 178, 428, 429, 433, 459, 508/465, 500, 506, 508, 509, 530, 531, 536, 508/110, 170
See application file for complete search history.

(56) References Cited

U.S. PATENT DOCUMENTS

| | | | | | |
|---|---|---|---|---|---|
| 3,970,574 | A | * | 7/1976 | Niedzielski | 252/79 |
| 3,992,306 | A | * | 11/1976 | Diery et al. | 508/508 |
| 4,156,095 | A | | 5/1979 | Jevne et al. | |
| 4,342,658 | A | | 8/1982 | Tincher et al. | |
| 4,390,439 | A | | 6/1983 | Schwartz et al. | |
| 4,402,907 | A | * | 9/1983 | Clark | 422/7 |
| 4,468,339 | A | * | 8/1984 | Rysek et al. | 252/75 |
| 4,493,780 | A | | 1/1985 | Schwartz et al. | |
| 5,053,534 | A | | 10/1991 | Cosgrove | |
| 5,055,231 | A | | 10/1991 | Hadamik et al. | |
| 5,132,046 | A | | 7/1992 | Edebo et al. | |
| 5,178,786 | A | | 1/1993 | Jahnke et al. | |
| 5,487,838 | A | | 1/1996 | Luciani et al. | |
| 5,723,061 | A | | 3/1998 | Ciardi et al. | |
| 6,585,933 | B1 | | 7/2003 | Ehrhardt et al. | |
| 6,590,030 | B2 | | 7/2003 | Salter et al. | |
| 7,306,750 | B2 | | 12/2007 | Maes et al. | |
| 2003/0134967 | A1 | | 7/2003 | Hukkanen | |
| 2003/0162671 | A1 | * | 8/2003 | Kalota et al. | 508/154 |
| 2004/0053791 | A1 | | 3/2004 | Langer et al. | |
| 2006/0217275 | A1 | | 9/2006 | Imai et al. | |
| 2007/0078068 | A1 | * | 4/2007 | Askew | 508/428 |
| 2007/0298983 | A1 | | 12/2007 | Theunissen et al. | |
| 2009/0036331 | A1 | | 2/2009 | Smith | |

FOREIGN PATENT DOCUMENTS

| | | | |
|---|---|---|---|
| GB | 2 408 748 | A | 6/2005 |
| WO | 92/19703 | | 11/1992 |
| WO | 99/35219 | | 7/1999 |
| WO | WO 9935219 | A1 * | 7/1999 |
| WO | 2007/130836 | | 11/2007 |

OTHER PUBLICATIONS

Ward, Jr. et al., "Industrial Utilization of $C_{21}$ Dicarboxylic Acid," Journal of the American Oil Chemists' Society, Sep. 3, 1974, Abstract.

"Ethoquad" http://www.linoakzo.co.jp/e/prod/p/43eqad_e.htm (evidentiary reference 2011).

* cited by examiner

*Primary Examiner* — Taiwo Oladapo
(74) *Attorney, Agent, or Firm* — Carmody & Torrance LLP

(57) ABSTRACT

An aqueous hydraulic fluid composition comprising (i) a salt of formic acid, and (ii) one or more lubricants such as a monovalent metal salt, ammonium, or amine salt of a dicarboxylic acid, is described in which the aqueous hydraulic fluid composition demonstrates increased thermal stability when exposed to elevated temperatures for a prolonged period of time while being able to tolerate the presence of 10% v/v synthetic seawater. The aqueous hydraulic fluid composition contains less than about 20% by weight (preferably none or substantially none) of an oil selected from the group consisting of mineral oils, synthetic hydrocarbon oils, and mixtures thereof. The hydraulic fluid preferably contains no glycols in some embodiments. The pH of the hydraulic fluid is preferably from 8 to 10 and is maintained by a buffer which preferably comprises borax in some embodiments.

26 Claims, No Drawings

ENVIRONMENTAL SUBSEA CONTROL HYDRAULIC FLUID COMPOSITIONS

CROSS REFERENCE TO RELATED APPLICATIONS

This is a continuation-in-part application of application Ser. No. 12/173,284, filed Jul. 15, 2008, the subject matter of which is herein incorporated by reference in its entirety.

FIELD OF THE INVENTION

This invention relates to aqueous hydraulic fluid compositions, especially hydraulic fluid compositions for use in actuating devices associated with offshore oil production, wherein in some embodiments the fluid can contain little or no glycols.

BACKGROUND OF THE INVENTION

Hydraulic fluids are low viscosity fluids used for the transmission of useful power by the flow of the fluid under pressure from a power source to a load. A liquid hydraulic fluid generally transmits power by virtue of its displacement under a state of stress. Hydraulic fluids generally operate with a low coefficient of friction. To be effective, the compositions typically have sufficient antiwear, antiweld, and extreme pressure properties to minimize metal damage from metal-to-metal contact under high load conditions.

Hydraulic fluids are usable in subsea control devices that are used to control well-head pressure of an oil well under production. The hydraulic equipment can open or close a well, choke the oil or gas flow, inject chemicals into the well or divert water and/or gas into the well to re-pressurise the system. Some of the hydraulic components are placed within the well, such as the Down Hole Safety Valve and "Smart Well" flow control systems.

One of the biggest challenges in the oil and gas industry is to "produce" oil and gas from harsher environments with high pressure and temperature. Since part of the hydraulic system is within the well, the hydraulic equipment and the associated fluid must also be suitable to survive the temperatures involved and maintain performance. In addition, the demand for aqueous based hydraulic fluid compositions such as may be used in subsea devices continues to increase due to the environmental, economic and safety (e.g. non-flammability) advantages of such fluids over conventional non-aqueous, oil-type hydraulic fluids.

Many conventional hydraulic fluids are not suitable for marine and deep sea applications due to their low tolerance to sea water contamination or to contamination by hydrocarbons, i.e., they tend to readily form emulsions with small amounts of seawater. Furthermore, in marine environments, problems arise due to the lack of biodegradability of the hydraulic fluid and to bacterial infestations arising in the hydraulic fluid, especially from anaerobic bacteria such as the sulphate reducing bacteria prevalent in sea water.

Other problems associated with the use of conventional hydraulic fluids under the extreme conditions encountered in marine and deep sea devices include: (1) some conventional hydraulic fluids may cause corrosion of metals in contact with the fluid; (2) some conventional hydraulic fluids are reactive with paints or other metal coatings or tend to react with elastomeric substances or at least cause swelling of elastomeric substances; (3) poor long-term stability, especially at elevated temperatures; (4) some hydraulic fluids require antioxidants to avoid the oxidation of contained components; (5) some hydraulic fluids are not readily concentrated for ease in shipping; and (6) many conventional hydraulic fluids have a non-neutral pH, thereby enhancing the opportunity for reaction with materials in contact with it. For all of these reasons, it has become advantageous to use aqueous hydraulic fluids in certain marine and deep sea applications and various aqueous formulations have been developed that are usable in such applications.

The OSPAR Convention for the Protection of the Marine Environment of the North-East Atlantic provides a framework for environmental requirements of chemicals used offshore. There are currently few if any water based fluids that can maintain lubrication at high temperature and meet the required environmental profile.

SUMMARY OF THE INVENTION

It is an object of the present invention to provide an improved aqueous hydraulic fluid composition for use under the extreme thermal conditions encountered in subsea control devices.

It is another object of the present invention to provide an aqueous hydraulic fluid composition that retains its lubricity after exposure to high temperatures and pressure.

It is still another object of the present invention to provide an aqueous hydraulic fluid concentrate that has good stability, even in the presence of 10% v/v synthetic seawater and can prevent or minimize the formation of problematic "hydrates".

It is still another object of the present invention to provide an aqueous hydraulic fluid composition that has greater thermal stability for a long period of time.

It is still another object of the present invention to provide a hydraulic fluid composition that contains materials that are environmentally acceptable substances.

It is still another object of this invention to provide an improved buffer system for such aqueous hydraulic fluid compositions.

It is a further object of this invention to provide a hydraulic fluid composition which may be substantially free of glycols.

To that end, the present invention in one embodiment relates to an improved aqueous hydraulic fluid composition comprising:

(i) water;
(ii) a salt or salts of formic acid;
(iii) a salt or salts or a dicarboxylic acid; and
(iv) alkali metal or ammonium hydroxide such that the pH of the fluid is between 7 and 10, preferably 8-10 or about 9.

The fluid also optionally comprises secondary corrosion inhibitors and secondary lubricants.

DETAILED DESCRIPTION OF THE INVENTION

The present invention is directed to an aqueous hydraulic fluid composition which is environmentally safe and preferably contains no mineral oils, hydrocarbon oils (natural or synthetic). The aqueous hydraulic fluid also preferably contains no glycols. Accordingly, the present invention relates to an aqueous hydraulic fluid composition comprising:

(i) water;
(ii) at least one salt of formic acid;
(iii) at least one salt of a dicarboxylic acid;
(iv) alkali metal or ammonium hydroxide such that the pH of the fluid is between 7 and 10, preferably, 8-10 or about 9;

wherein the hydraulic fluid composition is substantially free of mineral oils, hydrocarbon oils (natural or synthetic), and mixtures thereof. The hydraulic fluid composition can also be preferably free of glycols in some embodiments.

The salt or salts of formic acid are believed to act as a pour point depressant for the fluid. Preferably the salt is potassium formate. The concentration of the formate salt is preferably from 15% to 50% by weight of the fluid.

In one embodiment, the present invention utilizes an aqueous solution of a salt of a dicarboxylic acid. In one preferred embodiment, the dicarboxylic acid is an alkyl C21 or C18 dicarboxylic acid and the salt is a potassium salt or amine salt of the C21 or C18 dicarboxylic acid. It is believed that the potassium salt of this dicarboxylic acid is more water soluble than the dicarboxylic acid itself and is therefore preferable. One preferable compound in this regard is 2-cyclohexene-1-octanoic acid, 5-carboxy-4-hexyl and its salts. Generally the dicarboxylic acids (or salts thereof) used in this invention preferably have carbon chain lengths (straight, branched or cyclic) of from 2-30 carbons. Preferably the hydraulic fluid of the invention comprises more than one dicarboxylic acid or salt thereof. The concentration of the dicarboxylic acid salt in the hydraulic fluid of the invention should preferably range from 0.1% to 35% by weight. One preferred dicarboxylic acid is succinic acid and the alkali metal, amine or alkanol amine salts thereof. One function of the dicarboxylic acid salt is to act as the primary corrosion inhibitor of the fluid and as a primary lubricant.

In addition, the inventor of the present invention have determined that the lubrication, corrosion and other physical properties of the dicarboxylic acid salt(s) in hydraulic fluid formulations are maintained after exposure to high temperatures such as 190° C. for a considerable length of time (30 days or more). Certain amines and other salts of such dicarboxylic acids in the formulation are also believed to exhibit high thermal and seawater stability.

In addition, the hydraulic fluid composition of the invention may also preferably comprise a second lubricant, said second lubricant selected from the group consisting of alkyl/aryl phosphate esters, alkyl/aryl phosphite esters, phospholipids, mono, di, tri, or polymeric carboxylic acid salts and combinations of the foregoing. Phospholipids usable in the formulations of the invention include any lipid containing a phosphoric acid derivative, such as lecithin or cephalin, preferably lecithin or derivatives thereof. Examples of phospholipids include phosphatidylcholine, phosphatidylserine, phosphatidylinositol, phosphatidylethanolamine, phosphatidic acid and mixtures thereof. The phospholipids may also be glycerophospholipids, more preferably, glycero derivatives of the above listed phospholipids. Typically, such glycerophospholipids have one or two acyl groups on a glycerol residue, and each acyl group contains a carbonyl and an alkyl or alkenyl group. The alkyl or alkenyl groups generally contain from about 8 to about 30 carbon atoms, preferably 8 to about 25, most preferably 12 to about 24. Examples of these groups include octyl, dodecyl, hexadecyl, octadecyl, dodecanyl, octenyl, dodecenyl, hexadecenyl and octadecenyl. The concentration of the secondary lubricant in the hydraulic fluid of the invention should preferably range from 0.1 to 20% by weight.

The acyl groups on the glycerophospholipids are generally derived from fatty acids, which are acids having from about 8 to about 30 carbon atoms, preferably about 12 to about 24, most preferably about 12 to about 18 carbon atoms. Examples of fatty acids include myristic, palmitic, stearic, oleic, linoleic, linolenic, arachidic, arachidonic acids, or mixtures thereof, preferably stearic, oleic, linoleic, and linolenic acids or mixtures thereof.

Derivatives of phospholipids, including acylated or hydroxylated phospholipids may also be used in the practice of the invention. For instance, lecithin as well as acylated and hydroxylated lecithin may be used in the present invention as a primary or secondary lubricant.

Phospholipids may be prepared synthetically or derived from natural sources. Synthetic phospholipids may be prepared by methods known to those in the art. Naturally derived phospholipids are extracted by procedures known to those in the art. Phospholipids may be derived from animal or vegetable sources. Animal sources include fish, fish oil, shellfish, bovine brain and any egg, especially chicken eggs. Vegetable sources include rapeseed, sunflower seed, peanut, palm kernel, cucurbit seed, wheat, barley, rice, olive, mango, avocado, palash, papaya, jangli, bodani, carrot, soybean, corn, and cottonseed. Phospholipids may also be derived from micro organisms, including blue-green algae, green algae, bacteria grown on methanol or methane and yeasts grown on alkanes. In a preferred embodiment, the phospholipids are derived from vegetable sources, including soybean, corn, sunflower seed and cottonseed.

The preferred secondary lubricant is an ethoxylated acid phosphate ester, such as 2-ethyl hexyl acid phosphate with an average of 3 moles of ethoxylation. The concentration of the secondary lubricant in the fluid is preferably from about 0.1% to about 5% by weight of the fluid. Other suitable lubricants include fatty monoethanol amides or fatty diethanol amides.

The secondary lubricant may also comprise an alkoxylate salt as a second lubricant for the hydraulic fluid composition. The inventors of the present invention have determined that an improvement in lubricity and seawater stability may be realized by adding an alkoxylate salt (preferably a metal or amine salt of a mono, di, tri or polymeric alkoxylate) to the composition. Suitable alkoxylate salts include salts of alkoxylates with from 2 to 30 carbons in the alkoxylate carbon chain (straight, branched or cyclic). It is also known that typical compositions can be very difficult to stabilize thermally. The inventor of the present invention has surprisingly discovered that the use of alkoxylate salt(s) to the aqueous hydraulic fluid composition stabilizes the fluid composition from thermal degradation, even in the presence of 10% v/v synthetic seawater which gives the fluid compositions a much longer service life under extreme conditions.

Preferably, the fluid also contains a secondary corrosion inhibitor. One preferred secondary corrosion inhibitor is a caproic acid salt, more preferably an alkanolamine salt of a caproic acid, most preferably an arylsulfonamido caproic acid alkanolamine salt. If used, the concentration of the secondary corrosion inhibitor is preferably from about 1% to about 20% by weight of the fluid.

The aqueous hydraulic fluid compositions of the invention may also contain a biocide. The biocide is chosen so as to be compatible with the lubricating components, i.e., it does not affect lubricating properties. In one embodiment, a boron containing salt, such as borax decahydrate, is used simultaneously as the biocide and as a pH buffer. In another embodiment the biocide may be a sulfur-containing biocide or a nitrogen-containing biocide. Nitrogen-containing biocides include gluteraldehyde, triazines, oxazolidines, and guanidines as well as compounds selected from fatty acid quaternary ammonium salts, such as didecyl dimethyl quaternary ammonium chloride salt. The concentration of the biocide is sufficient to at least substantially prevent bacterial growth in the hydraulic fluid and preferably to kill the bacteria present.

The hydraulic fluid may also comprise an antifreeze additive capable of lowering the freezing point of the hydraulic fluid to at least about −30° F., which is below the minimum temperature expected to be encountered in such environments. If used, the antifreeze additive is chosen so as to be non-reactive with the lubricating components and biocide and is therefore not detrimental to the lubricating properties of the hydraulic fluid. In one embodiment, the anti-freeze additive comprises at least one alcohol having from 2 to 4 carbon atoms in an amount sufficient to reduce the freezing point to below −30° F. Suitable alcohols include monoethylene glycol, glycerol, propylene glycol, 2-butene-1, 4-diol, polyglycol ethers, polyethylene glycols or polypropylene glycols. In one preferred embodiment, monoethylene glycol, which is PLONOR approved is used as the anti-freeze additive of the invention in an amount sufficient to reduce the freezing point of the hydraulic fluid composition to the desired temperature whilst preventing the formation of "hydrates" in the subsea equipment during use. However, the hydraulic fluid can preferably be free of glycol in some embodiments.

The hydraulic fluid may also comprise one or more surfactants such as an alcohol etyoxylate to help with seawater stability (tolerance).

In addition to the above noted ingredients, it is important to maintain the pH of the hydraulic fluid preferably between 8 and 10, preferably between 9 and 9.5. Maintenance of the pH of the hydraulic fluid in the prescribed range is important for many reasons, including (i) minimizing corrosion or degradation of metal and/or plastic parts that come into contact with the hydraulic fluid, (ii) ease of handling the hydraulic fluid, and (iii) stability of the components of the hydraulic fluid. Thus it is important to provide a buffer in the hydraulic fluid to assist in maintaining the pH within the preferred range. In this regard the buffer must be stable and effective at the temperatures experienced by the hydraulic fluid which range from about 20° F. to about 420° F. The inventors herein have discovered that cyclical or ring based tertiary amines with no hydroxyl functionality are effective buffers in this regard. Borax (or borax decahydrate) is also a suitable buffer. Borax can be effectively used as a buffer whether the hydraulic fluid contains glycols or not. The foregoing compounds effectively buffer the pH of the hydraulic fluid to within 8 to 9.5 and are stable at the temperatures experienced by the hydraulic fluids. In choosing a preferred cyclical or ring based tertiary amine with no hydroxyl functionality, it is best to choose ring structures that will not break down or open at temperatures up to 420° F. One preferable ring based tertiary amine with no hydroxyl functionality which is particularly stable at high temperatures is 1,4-dimethyl piperazine. Other suitable ring based tertiary amines with no hydroxy functionality include 2-morpholinoethane sulfonic acid; N-methyl morpholine; N-methyl piperazine; N-methylpyrrolidine; 1,4-piperazine-Bis-ethanesulfonic acid; The concentration of the buffer in the hydraulic fluid is preferably from 0.1 to 6 weight percent, most preferably from 0.5 to 3 weight percent.

In addition, while the above-described embodiment is preferred for applications such as in hydraulic fluid for subsea control fluids encountered in or with off-shore oil drilling rigs, other embodiments are suitable for many applications. For example, in a substantially corrosion-free environment, a corrosion inhibitor need not be included in the composition of the hydraulic fluid. Similarly, in an environment in which bacterial infestation is not a problem, the biocide may be omitted. For applications at warm or elevated temperatures, a freezing-point depressant is not required.

In a particularly preferred embodiment, the hydraulic fluid is prepared as a ready to use concentrate which does not need diluting to achieve the working performance.

EXAMPLE I

An aqueous hydraulic fluid was prepared having the following formulation:

| Component | Weight Percent |
|---|---|
| Potassium Formate (75% by weight) | 46.67 |
| Succinic acid | 2.0 |
| Arylsulfonamido caproic acid aklanolaminesalt[o] | 10.0 |
| 2-ethylhexyl acid phosphate with 3 moles of ethoxylation | 0.5 |
| Water | 37.03 |

[o] Cas. No. 93981-14-7 available as Becrosan 2129

This composition was tested as a high pressure hydraulic fluid. It maintained its lubricity under load and was able to tolerate contamination with 10% w/w seawater. The pH of the hydraulic fluid was 9 and was maintained at about 9 through the foregoing prolonged use. The wear results were 13 wear teeth using a Falex anti-wear test. The sample also passed the IP 28% chip test for corrosion resistance.

EXAMPLE II

An aqueous hydraulic fluid was prepared having the following formulation:

| Component | Weight Percent |
|---|---|
| Succinic acid | 3.0 |
| 2-cyclohexene-1-octanoic acid, 5-carboxy-4-hexyl | 4.0 |
| Potassium hydroxide (50% w/w) | 9.5 |
| Borax decahydrate | 4.0 |
| Water | 35.5 |
| Monoethylene Glycol | 46.0 |

This composition was tested as a high pressure hydraulic fluid. It maintained its lubricity after prolonged use (30 days) at 190° C. and was able to tolerate contamination with 10% w/w seawater. The pH of the hydraulic fluid was 9 and was maintained at about 9 through the foregoing prolonged use. The wear results were acceptable. The sample also passed the IP 28% chip test for corrosion resistance.

What is claimed is:

1. An aqueous hydraulic fluid composition comprising:

(i) water;

(ii) at least one salt of formic acid;

(iii) at least one salt of a dicarboxylic acid in aqueous solution;

(iv) alkali metal or ammonium hydroxide such that the pH of the fluid is between 8 and 10;

wherein the fluid is substantially free of mineral oils, hydrocarbon oils.

2. The composition according to claim 1 wherein the dicarboxylic acid comprises succinic acid.

3. The composition according to claim 1 wherein the salt of formic acid comprises potassium formate.

4. The composition according to claim 1 wherein the dicarboxylic acid comprises an alkyl dicarboxylic acid with 18 or 21 carbon atoms.

5. The composition according to claim 1 wherein the composition also comprises an arylsulonamido caproic acid alkanolamine salt.

6. The composition according to claim 1 wherein the composition also comprises sodium borate.

7. The composition according to claim 1 wherein the composition also comprises an ethoxylated acid phosphate ester.

8. The composition according to claim 1, further comprising a lubricant, said lubricant selected from the group consisting of alkyl/aryl phosphate esters, alkyl/aryl phosphate esters, phospholipids, carboxylic acids, salts of carboxylic acids, and combinations of the foregoing.

9. The composition according to claim 8, wherein the lubricant comprises a phospholipids and the phospholipids comprises a phosphatide selected from the group consisting of phosphatidylcholine, phosphatidylinositol, phosphatidylserien, phosphatidylethanolamine and combinations of one or more of the foregoing.

10. The composition according to claim 1, wherein the composition further comprises a biocide.

11. The composition according to claim 10, wherein the biocide is selected from the group consisting of a boron containing salt, a sulfur-containing biocide or a nitrogen-containing biocide.

12. The composition according to claim 1, wherein the composition further comprises of one or more secondary corrosion inhibitors.

13. The composition according to claim 12, wherein the secondary corrosion inhibitor is selected from the group consisting of alkyl/aryl phosphate esters, alkyl/aryl phosphate esters, phospholipids, carboxylic acids, salts of carboxylic acids, and combinations of the foregoing.

14. The composition according to claim 2 wherein the composition comprises potassium formate.

15. The composition according to claim 14 wherein the composition also comprises an arylsulfonamido caproic acid alkanol amine salt.

16. A aqueous hydraulic fluid composition comprising:

(i) water;

(ii) at least one salt of a dicarboxylic acid in aqueous solution;

(iii) sodium borate;

(iv) hydroxide ions such that the pH of the fluid is between 8 and 10 wherein the fluid is substantially free of mineral oils and hydrocarbon oils.

17. The composition according to claim 16 wherein the composition also comprises monoethylene glycol.

18. The composition according to claim 17 wherein the dicarboxylic acid comprises succinic acid.

19. The composition according to claim 17 wherein the dicarboxylic acid comprises an alkyl dicarboxylic acid with 18 or 21 carbon atoms.

20. The composition according to claim 16 wherein the composition also comprises an arylsulfonamido caproic acid aklanolamine salt.

21. The composition according to claim 16 wherein the composition also comprises an ethoxylated acid phosphate ester.

22. The composition according to claim 21 wherein the dicarboxylic acid comprises succinic acid.

23. The composition according to claim 22 wherein the composition also comprises an arylsulfonamido caproic acid alkanolamine salt.

24. The composition according to claim 16 wherein the composition is free of glycols.

25. The composition according to claim 24 wherein the composition also comprises a salt of formic acid.

26. A composition according to claim 1 wherein the composition comprises no glycol.

* * * * *